US007892640B2

(12) United States Patent
Nakai

(10) Patent No.: US 7,892,640 B2
(45) Date of Patent: Feb. 22, 2011

(54) CONJUGATE FIBERS EXCELLENT IN ANTISTATIC PROPERTY, WATER ABSORPTION AND COOL FEELING BY CONTACT

(75) Inventor: Yasushi Nakai, Fukui (JP)

(73) Assignee: KB Seiren, Ltd., Fukui (JP)

( * ) Notice: Subject to any disclaimer, the term of this patent is extended or adjusted under 35 U.S.C. 154(b) by 0 days.

(21) Appl. No.: 12/524,950

(22) PCT Filed: Apr. 3, 2008

(86) PCT No.: PCT/JP2008/056700

§ 371 (c)(1),
(2), (4) Date: Jul. 29, 2009

(87) PCT Pub. No.: WO2008/123586

PCT Pub. Date: Oct. 16, 2008

(65) Prior Publication Data

US 2010/0047572 A1 Feb. 25, 2010

(30) Foreign Application Priority Data

Apr. 4, 2007 (JP) ..... 2007-098045

(51) Int. Cl.
*D02G 3/00* (2006.01)

(52) U.S. Cl. ..... 428/370; 428/373; 428/374

(58) Field of Classification Search ..... 428/370, 428/373, 374
See application file for complete search history.

(56) References Cited

U.S. PATENT DOCUMENTS 3,558,419 A * 1/1971 Okazaki et al. ..... 428/374
3,607,611 A * 9/1971 Matsui et al. ..... 428/374
6,248,445 B1 * 6/2001 Yamakawa et al. ..... 428/373
6,783,853 B2 * 8/2004 Figuly et al. ..... 428/370
6,811,871 B2 * 11/2004 Sen et al. ..... 428/357
7,135,228 B2 * 11/2006 Sen et al. ..... 428/373
7,727,627 B2 * 6/2010 Sen et al. ..... 428/373
2003/0186041 A1 * 10/2003 Fujita et al. ..... 428/304.4
2007/0020453 A1 * 1/2007 Sen et al. ..... 428/373
2010/0047572 A1 * 2/2010 Nakai ..... 428/373

FOREIGN PATENT DOCUMENTS

JP 44-10488 5/1969
JP 357047918 A * 3/1982 ..... 428/373
JP 03-213547 9/1991
JP 06-136618 5/1994
JP 09-013257 1/1997
JP 2004-270075 9/2004
JP 2005-273085 6/2005

* cited by examiner

*Primary Examiner*—N. Edwards
(74) *Attorney, Agent, or Firm*—Kirschstein, US/AP.

(57) ABSTRACT

The present invention provides novel conjugate fibers being excellent in productivity and having good water absorption, antistatic property and cool feeling by contact. The conjugate fibers include a fiber-forming resin such as polyamide, polyester and the like in the sheath portion and a polyether block amide copolymer in the core portion, in which the area ratio of the core portion to the sheath portion is 5/95 to 95/5, and the exposure angle of the core portion to the surface is 5° to 90°. Specifically it is preferable that the area ratio of the core portion to the sheath portion is 10/90 to 90/10, the exposure angle of the core portion to the surface is 5° to 80°, and the crimp ratio is 2 to 30%.

5 Claims, No Drawings

CONJUGATE FIBERS EXCELLENT IN ANTISTATIC PROPERTY, WATER ABSORPTION AND COOL FEELING BY CONTACT

TECHNICAL FIELD

The present invention relates to conjugate fibers excellent in antistatic property, water absorption and cool feeling by contact.

BACKGROUND ART

Conventionally, polyamide fibers and polyester fibers have excellent properties for such as yarn strength, antiwearing property, dyeing property, and processing property, and are widely used for clothing use, and industrial material use and the like. Among synthetic fibers, polyamide fibers and polyester fibers, specifically polyamide fibers have high water absorption, but natural fibers have more superior water absorption, and therefore natural fibers are widely used for underwear and the like used in summer season when sweating increases. Furthermore, in order to suppress generation of static electricity in winter season, a fabric having antistatic property has attracted the attention of many people. Moreover, cool-feeling fibers that provide cool feeling upon contact with skin, are also developed as the products which relate to the Cool Biz campaign in summer season.

For example, as antistatic property fibers, fibers with a hydrophilic polymer being incorporated into polyamide fibers or polyester fibers, and fibers with conductive particles, specifically conductive carbon black, being incorporated, have been developed. However, fibers with a hydrophilic polymer being incorporated exhibit antistatic property by absorbing moisture and do not have antistatic effect under a low moisture condition. On the other hand, fibers with conductive particles, specifically conductive carbon black, being incorporated, can be provided with antistatic property even under a low moisture condition, but do not have water absorption and cool feeling by contact.

In order to improve the water absorption and the antistatic property, a technique for conjugating a polyamide and an aliphatic block polyetheramide is disclosed. However, when a large amount of the block polyetheramide is conjugated so as to provide water absorption, color tone of the conjugate fibers becomes intense yellow and the use of the fibers is limited, and the use is also limited in that manufacture cost of the block polyetheramide is expensive. Furthermore, the property of cool feeling by contact is not mentioned (Patent Document 1).

In order to compensate the above-mentioned drawbacks, complete core-sheath type conjugate fibers having a polyether ester amide in the core portion and a polyamide resin in the sheath portion are disclosed, but the fibers have a drawback of having an insufficient water absorbing effect because of the polyether ester amide not exposed on the surface, and further they have only low cool feeling by contact (Patent Document 2).

Fibers made by use of a polyether block amide copolymer are disclosed to have cool feeling by contact (Patent Document 3). However, since the fibers are composed of only a polyether block amide copolymer, although they can have cool feeling by contact, they are not suitable for industrial manufacture, because the polyether block amide copolymer itself easily discolors and it is hard to be dyed and has a high friction.

Furthermore, fibers having antistatic property, water absorption and cool feeling by contact, made of a core-sheath conjugate fiber in which the core portion is composed of a mixture of a polyether ester amide and a polyester are disclosed (Patent Document 4), but they can not have sufficient water absorption and cool feeling by contact since the core portion which provides water absorption and cool feeling by contact is not exposed.

Patent Document 1: JP-B-S44-10488
Patent Document 2: JP-A-H06-136618
Patent Document 3: JP-A-2004-270075
Patent Document 4: JP-A-2005-273085

DISCLOSURE OF THE INVENTION

Problem to be Solved by the Invention

An object of the present invention is to provide novel conjugate fibers excellent in productivity and having good water absorption, antistatic property and cool feeling by contact.

Means for Solving the Problem

The present invention has solved the above-mentioned problems by a conjugate fiber having a fiber-forming resin in a sheath portion and a polyether block amide copolymer in a core portion, in which the area ratio of the core portion to the sheath portion is 5/95 to 95/5, and the exposure angle of the core portion to the surface is 5° to 90°.

Namely, the present invention makes it possible to provide an eccentric core-sheath type conjugate fiber in which a part of the core component is exposed to the surface, which is excellent in all of antistatic property, water absorption and cool feeling by contact and is suitable for practical use, by specifying a combination of the core component and the sheath component and the constitutional ratio thereof, as well as the exposure angle of the core portion to the surface.

Here, the area ratio (the ratio of the cross sectional area) of the core portion to the sheath portion is preferably 90/10 or less from the viewpoint of productivity of spun yarn and workability of post-processes such as dyeing. Furthermore, the exposure angle of the core portion to the surface is preferably 80° (80/360 of the surface—the circumference—of conjugate fiber) or less. When the exposure angle is within this range, the fiber is excellent in water absorption, antistatic property and cool feeling by contact, and has good productivity and dyeing property.

A crimp ratio of the fiber is preferably 2 to 30%, and more preferably 3 to 20%. When the crimp ratio is within this range, the fiber is excellent in water absorption and cool feeling by contact, and its feeling is also good.

Furthermore, from the viewpoint of antistatic property and cool feeling by contact, the area ratio (the ratio of the cross sectional area) of the core portion to the sheath portion is 10/90 or more, more preferably 20/80 or more.

Here, the polyether block amide copolymer used for the core portion of the conjugate fiber of the present invention is a copolymer obtained by copolymerization of a polyamide unit having reactive end groups and a polyether unit having reactive end groups, such as (1) a polyamide unit having diamine ends and a polyoxyalkylene unit having dicarboxylic acid group ends, (2) a polyamide unit having dicarboxylic acid group ends and polyetherdiol, (3) a polyamide unit having dicarboxylic acid group ends and a polyoxyalkylene unit having diamine ends (which is obtained by cyanoethylation and hydrogenation of a polyoxyalkylene having two hydroxyl groups on α-position and ω-position). In the present invention, (2) is preferable, which is represented by the following general formula:

$$HO—(CO\text{-}PA\text{-}CO—O\text{-}PE\text{-}O)_n—H$$

wherein PA represents a polyamide unit (hard segment), PE represents a polyether unit (soft segment), and n represents a repeating unit.

Furthermore, as the polyamide unit, such as nylon 6, nylon 6,6, and nylon 12, and as the polyether unit, such as polyethyleneglycol, and polytetraethylene glycol are preferably used. Examples of the commercially available one include such as Pebax (registered trademark) manufactured by Axkema Inc. Among them, when Pebax MV1074 or MH1657 is used, specifically good antistatic property can be obtained.

Next, the fiber-forming polymer that composes the sheath portion of the conjugate fiber of the present invention may be fiber-forming polymers that can be melt-spun, and specific examples of such polymers include polyamides such as nylon 6 and nylon 66; polyesters such as polyethylene telephthalate, polybutylene telephthalate, polyethylene naphthalate, fully aromatic polyester and polylactic acid; polyolefins such as polyethylene and polypropylene; as well as a polymer containing them as a main component; and heat resistant thermoplastic polymers such as polyphenylene sulfide and polyetherether ketone. Polyamides (specifically nylon 6) and polyesters (specifically polyester, polyethylenetelephthalate or polylactic acid) are preferably used.

The conjugate fiber of the present invention can be produced by using a conventional conjugate-type conjugate spinning device. It can be produced by a method in which spinning is carried out at a conventional velocity of about 500 m/min to 1500 m/min, and then drawing and heat-treatment are applied, or a high-speed spinning method such as spin drawing method.

Here, the above-mentioned fiber-forming polymer that composes the sheath portion may include a small amount of any other polymer, and additives such as an antioxidant, a pigment, a matting agent, an antibacterial agent, and inert microparticles.

Effect of the Invention

According to the present invention, a conjugate fiber having practical dyeing property, as well as being excellent in water absorption, hygroscopic property, antistatic property and cool feeling by contact, and having good productivity can be obtained. Such a conjugate fiber of the present invention can be processed into a fabric that is comfortable to wear in direct contact with skin, and can therefore be widely used in the fields, for example, wears such as underwear, lining, sweater, shirt, business suit, panty stocking, socks, hat, scarf, working wear, clothes for sport such as ski- or skate-wears, diving suits, wears for fishing or mountain climbing and training wear, bedding such as sheets and inner cotton, as well as products such as gloves, inner material for shoes, inner material for a helmet, interior material for vehicle, interior material for indoor use, and synthetic leather fabric.

BEST MODE FOR CARRYING OUT THE INVENTION

Although the thickness (total fineness) of the conjugate fiber of the present invention is not specifically limited, it is preferably about 1 dtex to 100 dtex. When the fineness is 1 dtex or more, the fiber can be easily formed, and when the fineness is 100 dtex or less, the fiber can be processed into a fabric such as knitted or woven fabric, which makes possible the production of soft clothing.

Furthermore, the conjugate fiber of the present invention can be used in any form as the fibers for composing a fabric (knitted or woven fabric), which may be such as multifilament, monofilament, and staple. Furthermore, the filament may be a false-twist textured yarn, an air mixed yarn, a designed yarn such as a core spun yarn, and a covering yarn. Moreover, the staple may be processed into a spun yarn.

Moreover, the form of the fabric produced by using the conjugate fiber of the present invention is not limited, and the knitted structure may be either weft knitting or warp knitting, or modified structure thereof. The woven structure may be such as plain weave (plain), twill weave (twill), and satin weave (satin) or the modified structure thereof, or may be Dobby weave, Jacquard weave, and the like. In addition, it can be utilized as a lace, a non-woven fabric and a felt.

In the form of such fabrics, the total weight and the gauge are not specifically limited. In addition, the conjugate fiber of the present invention may be used by 100% by weight, or may be used by cross-knitting or cross-weaving with other fibers. Furthermore, it may be used by blending with natural fibers. Although the proportion of the conjugate fiber of the present invention to be used is not specifically limited, it is preferable to use it by the proportion of 20% to 100% by weight.

By using the fabric having such function for clothing such as underwear, sweater, shirt, and panty stocking, sport clothing such as ski wear, skate wear, and diving suit, bedding such as sheets and inner cotton, and materials such as food wrapping material, these products can be provided with the function.

EXAMPLES

Hereinafter the present invention is described in detail by the Examples. The present invention is not intended to be limited to only these Examples. Here, each characteristic value in the Examples was obtained by the following methods.

<Water Absorption>

Byreck method was used. Using a piece of knitted fabric of 20 cm×2.5 cm as a sample, height (cm) of water raised by capillary phenomenon within 10 minutes at water temperature of 20° C. was measured.

<Hygroscopic Property>

A piece of knitted fabric of 20 cm×2.5 cm as a sample was put into a constant temperature and humidity test chamber at 25° C., 90% RH. Increase of the weight after 24 hours was measured, and the increase of the weight relative to the initial weight was represented by %.

<Antistatic Property (Friction Electrification Voltage)>

Measured by JIS L-1094-1997 frictional electrification attenuation measurement method.

Measurement of frictional electrification voltage: electrostatic tester

Rubbing cloth: wool, cotton

Rubbing direction: transverse direction

Washing treatment: washed (3 times)

Temperature and humidity: 20° C.×33% RH

<Cool Feeling by Contact (q-max)>

A piece of a knitted fabric which was obtained by tube-knitting (smooth-knitting), refining, drying and then dyeing was used as a sample. Using Thermolabo II type measurement apparatus (manufactured by Kato tech Co., Ltd.), and adjusting BT-Box to 34° C. in a room having a room temperature of 24° C. and a humidity of 63% RH, the BT-Box (pressure: 10 g/cm$^2$) was mounted on a sample whose humidity was sufficiently adjusted, and the heat flow rate per a unit area under the temperature difference of 10° C. was measured. In this measurement method, q-max is preferably 0.110 (J/m$^2$·sec) or more.

<Exposure Angle of Core Portion>

After the fiber was dyed, cross-section of the fiber was obtained by using a microtome, and a photograph was taken by using a stereomicroscope. Two straight lines were drawn from the central point of the fiber to the ends of the exposed portion, and the angle was measured by using a protractor.

<Dyeing Processability>

Dyeing processability is shown by a result of dyeing the knitted fabric at 90° C. for 30 minutes in a liquid-flow dyeing machine with use of an acidic dye and a metal complex salt mordant dye.

Examples 1 to 45 and Controls 1 to 20

With use of a polyether block polyamide copolymer [Pebax MV1074 SN01 manufactured by Arkema Inc.] as the core component and nylon 6 as the sheath component, eccentric core-sheath type conjugate fibers were produced, in which the ratio of the core and sheath and the exposure angle of the core component to the surface are as shown in Table 1.

In all cases, a knitted fabric was obtained by smooth-knitting at thickness of the fiber of 78 T/24 f and a total weight of 150 g/m$^2$, and was refined using a 5 wt % solution of sodium hydroxide for 30 minutes, dried under heating at 140° C. for 2 to 3 minutes, dyed at 90° C. for 30 minutes, and then dried at 112° C. for 2 to 3 minutes and treated under heating at 165° C. for 30 to 45 seconds.

For the products thus obtained, the results of physical characteristic test and the like are shown in Tables 1 and 2.

TABLE 1

| | Core/ | Exposure angle | q-max | Water absorption | Hygroscopic property | Frictional electrification voltage | | Spinning | Dyeing | |
|---|---|---|---|---|---|---|---|---|---|---|
| | Sheath | (°) | (J/cm$^2$ · sec) | (cm) | (%) | Initial voltage | Half life (sec) | productivity | processability | Total |
| Control 1 | —/100 | — | 0.101 | 2.5 | 7.5 | 16000 | 60≦ | ◎ | ◎ | X |
| Control 2 | 5/95 | 0 | 0.100 | 5.3 | 7.8 | 14400 | 48.0 | ◎ | ◎ | X |
| Example 1 | " | 5 | 0.110 | 5.5 | 7.9 | 13500 | 16.8 | ◎ | ◎ | Δ |
| Example 2 | " | 30 | 0.114 | 6.1 | 8.1 | 13000 | 10.0 | ◎ | ◎ | Δ |
| Example 3 | " | 55 | 0.116 | 6.3 | 8.4 | 12500 | 8.7 | ◎ | ◎ | Δ |
| Example 4 | " | 80 | 0.119 | 6.8 | 8.8 | 11890 | 6.6 | ◎ | ◎ | Δ |
| Example 5 | " | 90 | 0.122 | 7.1 | 9.1 | 10350 | 5.2 | ○~Δ | ○ | Δ |
| Control 3 | " | 100 | 0.125 | 7.4 | 9.6 | 9900 | 4.4 | Δ~X | Δ~X | X |
| Control 4 | 10/90 | 0 | 0.102 | 6.5 | 7.8 | 12450 | 32.0 | ◎ | ◎ | X |
| Example 6 | " | 5 | 0.111 | 6.6 | 8.7 | 11200 | 6.8 | ◎ | ◎ | ○ |
| Example 7 | " | 30 | 0.117 | 6.9 | 9.0 | 11100 | 5.2 | ◎ | ◎ | ○ |
| Example 8 | " | 55 | 0.122 | 7.4 | 9.1 | 11080 | 3.3 | ◎ | ◎ | ○ |
| Example 9 | " | 80 | 0.128 | 7.8 | 9.3 | 10060 | 2.5 | ◎ | ◎ | ○ |
| Example 10 | " | 90 | 0.131 | 7.8 | 9.4 | 9760 | 2.1 | ○~Δ | ○ | ○ |
| Control 5 | " | 100 | 0.134 | 8.1 | 9.5 | 8800 | 1.8 | Δ~X | Δ~X | X |
| Control 6 | 20/80 | 0 | 0.102 | 6.6 | 8.0 | 10600 | 6.5 | ◎ | ◎ | X |
| Example 11 | " | 5 | 0.114 | 7.3 | 9.1 | 9000 | 2.6 | ◎ | ◎ | ◎ |
| Example 12 | " | 30 | 0.129 | 8.2 | 10.5 | 8800 | 2.1 | ◎ | ◎ | ◎ |
| Example 13 | " | 55 | 0.142 | 8.9 | 11.6 | 8400 | 1.0 | ◎ | ◎ | ◎ |
| Example 14 | " | 60 | 0.154 | 9.7 | 12.7 | 7500 | 0.9 | ◎ | ◎ | ◎ |
| Example 15 | " | 90 | 0.156 | 10.6 | 13.5 | 6800 | 0.8 | ○~Δ | ○ | ○ |
| Control 7 | " | 100 | 0.160 | 11.4 | 15.3 | 5150 | 0.8 | Δ~X | Δ~X | X |
| Control 8 | 33/67 | 0 | 0.102 | 6.8 | 8.1 | 6300 | 5.2 | ◎ | ◎ | X |
| Example 16 | " | 5 | 0.115 | 8.4 | 9.3 | 5600 | 3.1 | ◎ | ◎ | ◎ |
| Example 17 | " | 30 | 0.146 | 10.8 | 12.7 | 4900 | 1.4 | ◎ | ◎ | ◎ |
| Example 18 | " | 55 | 0.164 | 12.0 | 14.0 | 4200 | 0.6 | ◎ | ◎ | ◎ |
| Example 19 | " | 80 | 0.176 | 13.5 | 15.4 | 3800 | 0.5 | ◎ | ◎ | ◎ |
| Example 20 | " | 90 | 0.183 | 14.2 | 16.3 | 3260 | 0.5 | ○~Δ | ○ | ○ |
| Control 9 | " | 100 | 0.189 | 14.8 | 17.2 | 2960 | 0.4 | Δ~X | Δ~X | X |
| Control 10 | '50/50 | 0 | 0.103 | 6.9 | 8.2 | 4350 | 3.6 | ◎ | ◎ | X |
| Example 21 | " | 5 | 0.115 | 10.1 | 10.2 | 3100 | 1.4 | ◎ | ◎ | ◎ |
| Example 22 | " | 30 | 0.156 | 13.8 | 16.2 | 2220 | 0.8 | ◎ | ◎ | ◎ |
| Example 23 | " | 55 | 0.174 | 15.5 | 18.0 | 1740 | 0.4 | ◎ | ◎ | ◎ |

TABLE 2

| | | | | | | | | | | |
|---|---|---|---|---|---|---|---|---|---|---|
| Example 24 | " | 80 | 0.183 | 16.4 | 19.3 | 1210 | 0.4 | ◎ | ◎ | ◎ |
| Example 25 | " | 90 | 0.191 | 17.3 | 20.2 | 1130 | 0.4 | ○~Δ | ○ | ○ |
| Control 11 | " | 100 | 0.194 | 18.1 | 20.9 | 1150 | 0.3 | Δ~X | Δ~X | X |
| Control 12 | 67/33 | 0 | 0.103 | 7.0 | 8.3 | 3400 | 1.8 | ◎ | ◎ | X |
| Example 26 | " | 5 | 0.118 | 12.3 | 11.6 | 2500 | 0.9 | ◎ | ◎ | ◎ |
| Example 27 | " | 30 | 0.166 | 17.2 | 18.9 | 1400 | 0.3 | ◎ | ◎ | ◎ |
| Example 28 | " | 55 | 0.188 | 18.9 | 22.0 | 1110 | 0.3 | ◎ | ◎ | ◎ |
| Example 29 | " | 80 | 0.194 | 19.6 | 23.2 | 1010 | 0.3 | ◎ | ◎ | ◎ |
| Example 30 | " | 90 | 0.199 | 20.5 | 24.6 | 1020 | 0.3 | ○~Δ | ○ | ○ |
| Control 13 | " | 100 | 0.201 | 21.4 | 25.3 | 890 | 0.3 | Δ~X | Δ~X | X |
| Control 14 | 80/20 | 0 | 0.106 | 7.1 | 8.3 | 2860 | 1.6 | ◎ | ◎ | X |
| Example 31 | " | 5 | 0.122 | 15.7 | 12.4 | 1460 | 0.8 | ◎ | ◎ | ◎ |
| Example 32 | " | 30 | 0.188 | 21.8 | 20.6 | 1100 | 0.3 | ◎ | ◎ | ◎ |
| Example 33 | " | 55 | 0.206 | 24.6 | 25.8 | 880 | 0.3 | ◎ | ◎ | ◎ |
| Example 34 | " | 80 | 0.210 | 25.4 | 26.6 | 640 | 0.3 | ◎ | ◎ | ◎ |
| Example 35 | " | 90 | 0.222 | 26.3 | 27.8 | 610 | 0.3 | ○~Δ | ○ | ○ |
| Control 15 | " | 100 | 0.231 | 27.1 | 28.6 | 560 | 0.3 | Δ~X | Δ~X | X |
| Control 16 | 90/10 | 0 | 0.107 | 7.2 | 8.4 | 2150 | 1.3 | ◎ | ◎ | X |
| Example 36 | " | 5 | 0.132 | 17.6 | 17.4 | 1250 | 0.8 | ◎ | ◎ | ○ |
| Example 37 | " | 30 | 0.210 | 23.6 | 28.5 | 880 | 0.3 | ◎ | ◎ | ○ |
| Example 38 | " | 55 | 0.232 | 27.3 | 32.5 | 640 | 0.3 | ◎ | ◎ | ○ |
| Example 39 | " | 80 | 0.233 | 28.5 | 33.5 | 580 | 0.3 | ◎ | ◎ | ○ |
| Example 40 | " | 90 | 0.236 | 29.4 | 34.7 | 530 | 0.2 | ○~Δ | ○~Δ | ○ |
| Control 17 | " | 100 | 0.233 | 30.6 | 35.4 | 490 | 0.2 | Δ~X | Δ~X | X |
| Control 18 | 95/5 | 0 | 0.108 | 7.3 | 8.6 | 2100 | 1.2 | ○ | ○ | X |
| Example 41 | " | 5 | 0.136 | 17.8 | 18.5 | 1310 | 0.7 | ○~Δ | Δ | Δ |
| Example 42 | " | 30 | 0.221 | 25.5 | 30.7 | 720 | 0.3 | ○~Δ | Δ | Δ |
| Example 43 | " | 55 | 0.236 | 28.4 | 33.8 | 650 | 0.3 | ○~Δ | Δ | Δ |
| Example 44 | " | 80 | 0.240 | 29.3 | 34.6 | 550 | 0.3 | ○~Δ | Δ~X | Δ |
| Example 45 | " | 90 | 0.243 | 30.3 | 35.5 | 520 | 0.2 | Δ | X | Δ |
| Control 19 | " | 100 | 0.244 | 31.6 | 36.7 | 490 | 0.2 | Δ~X | X | X |
| Control 20 | 100/— | — | 0.246 | 33.5 | 44.0 | 490 | 0.2≦ | XX | X | X |

Example 46

With use of a conjugate fiber having fineness of 78 T/24 f, strength of 3.8 cn/dtex and extension degree of 35%, and being composed of a conjugate fiber in which a polyether block polyamide copolymer [Pebax MV1074 SN01 manufactured by Arkema Inc.] as a core component and nylon 6 as a sheath component were used, and the surface area ratio of the core portion to the sheath portion is ½ and the exposure angle of the core portion is 55°, a product was obtained by smooth-knitting at a total weight of 150 g/m$^2$ according to the same method as Example 1, and the characteristic tests were carried out.

The test results are shown in Tables 3 to 5.

Here, the 100% fabric of the present invention refers to the knitted fabric made of solely the conjugate fiber, and the 80%, 50% and 30% fabrics of the present invention refer to cross-knitted fabrics made of the conjugate fiber and nylon fiber, in which the amount of the conjugate fiber used is 80%, 50% and 30%, respectively Water absorption, hygroscopic property and antistatic property were measured according to the same method as Example 1, and cool feeling by contact was measured according to the same method as Example 1 except that the room temperature was 21° C. and the humidity was 55%.

TABLE 3

| Cool feeling by contact | Fabric of the present invention | | | | Regular nylon |
|---|---|---|---|---|---|
| (J/cm$^2$ · sec) | 100% | 80% | 50% | 30% | 100% |
| Average | 0.171 | 0.163 | 0.155 | 0.146 | 0.101 |

TABLE 4

| Samples | Water absorption (cm) | | Hygroscopic |
|---|---|---|---|
| | longitudinal direction | transverse direction | property (%) |
| Fabrics of the present invention | | | |
| 100% | 11.6 | 12.0 | 14.0 |
| 80% | 11.2 | 10.7 | 13.1 |
| 50% | 10.6 | 9.6 | 11.6 |
| 30% | 9.3 | 8.8 | 9.8 |
| Regular nylon | 2.5 | 2.0 | 7.5 |

TABLE 5

| Samples | Rubbing cloth | Rubbing direction | Directly after (V) | After 10 sec. (V) | After 30 sec. (V) | After 60 sec. (V) | Half life (sec.) |
|---|---|---|---|---|---|---|---|
| Fabric | cotton | longitudinal | 890 | 200 | 140 | 90 | 0.5 |
| of this | | transverse | 740 | 160 | 100 | 70 | 0.6 |
| invention | wool | longitudinal | 740 | 130 | 90 | 50 | 0.5 |
| 100% | | transverse | 570 | 90 | 60 | 40 | 0.5 |

TABLE 5-continued

| Samples | Rubbing cloth | Rubbing direction | Directly after (V) | After 10 sec. (V) | After 30 sec. (V) | After 60 sec. (V) | Half life (sec.) |
|---|---|---|---|---|---|---|---|
| Fabric | cotton | longitudinal | 1180 | 630 | 240 | 90 | 0.9 |
| of this | | transverse | 960 | 450 | 310 | 60 | 0.8 |
| invention | wool | longitudinal | 860 | 420 | 290 | 80 | 0.7 |
| 50% | | transverse | 750 | 380 | 260 | 80 | 0.7 |
| Fabric | cotton | longitudinal | 1990 | 830 | 340 | 110 | 1.5 |
| of this | | transverse | 1460 | 770 | 270 | 130 | 0.8 |
| invention | wool | longitudinal | 1580 | 750 | 180 | 90 | 0.7 |
| 30% | | transverse | 1840 | 650 | 160 | 70 | 0.8 |
| Regular | cotton | longitudinal | 14000 | 10440 | 8500 | 6980 | 50.8 |
| nylon | | transverse | 14820 | 13760 | 13060 | 12340 | 60< |
| | wool | longitudinal | 13020 | 12540 | 12220 | 11880 | 60< |
| | | transverse | 18120 | 17160 | 16680 | 16160 | 60< |

As shown in Tables 3 to 5, the fabrics made of the conjugate fiber of the present invention are very superior to the fabric composed of regular nylon in all of cool feeling by contact, water absorption, hygroscopic property and antistatic property.

Examples 47 to 49 and Controls 21 to 29

Conjugate fibers and fabrics were produced according to the same manner as Example 1, except that the ratio of the core portion and the sheath portion was changed as shown in Table 6.

The section (shape of cross-section) and the exposure angle of the core portion, the crimp ratio, the cool feeling by contact and the like of the obtained conjugate fibers are shown in Table 6.

TABLE 6

| | core/ sheath | exposure angle (°) | crimp ratio (%) | q-max ($J/cm^2 \cdot sec$) | section | total |
|---|---|---|---|---|---|---|
| Control 21 | —/100 | — | — | 0.101 | ○ | X |
| Control 22 | 10/90 | 0 | — | 0.102 | | X |
| Control 23 | 10/90 | 0 | 1.6 | 0.103 | | X |
| Example 47 | 10/90 | 55 | 3.1 | 0.122 | | ○ |
| Control 24 | 10/90 | 55 | — | 0.106 | | X |
| Control 25 | 33/67 | 0 | — | 0.102 | | X |
| Control 26 | 33/67 | 0 | 2.2 | 0.104 | | X |
| Example 48 | 33/67 | 55 | 5.5 | 0.164 | | ◎ |
| Control 27 | 33/67 | 55 | — | 0.108 | | X |
| Control 28 | '50/50 | 0 | — | 0.103 | | X |
| Example 49 | '50/50 | 55 | 6.7 | 0.174 | | ◎ |
| Control 29 | '50/50 | 55 | — | 0.109 | | X |

The crimp ratio is a value calculated by the following formula.

$$\text{Potential crimp ratio}=(L0-L1)\times 100/L0$$

Load (denier×1.2 mg) was applied to a sample of 500 mm (L0). The sample was hanged and sample length after 30 minutes (L1) was measured.

The invention claimed is:

1. A conjugate fiber excellent in antistatic property, water absorption and cool feeling by contact comprising: a sheath portion composed of a fiber-forming resin, a core portion composed of a polyether block amide copolymer, an area ratio of the core portion to the sheath portion being 5/95 to 95/5, a part of the core portion being exposed to an outer surface of the fiber, an exposure angle of the core portion to the outer surface of the fiber being 5° to 90°, the exposure angle being the angle formed between two straight lines extending from a central point of the fiber to opposite ends of the exposed part of the core portion, and the fiber being crimped with a crimp ratio between 2% to 30%.

2. The conjugate fiber according to claim 1, wherein the area ratio of the core portion to the sheath portion is 10/90 to 90/10.

3. The conjugate fiber according to claim 1, wherein the exposure angle of the core portion to the outer surface of the fiber is 5° to 80°.

4. The conjugate fiber according to claim 1, wherein the crimp ratio is 3% to 20%.

5. The conjugate fiber according to claim 1, wherein the fiber-forming resin is a polyamide or polyester resin.

* * * * *